US008771600B2

(12) United States Patent
Ray

(10) Patent No.: US 8,771,600 B2
(45) Date of Patent: Jul. 8, 2014

(54) ELECTROSTATIC FILTER AND NON-THERMAL PLASMA SYSTEM FOR AIR POLLUTION CONTROL OF HYDROCARBON COMBUSTION ENGINES

(76) Inventor: Isaac Ray, Brooklyn, NY (US)

( * ) Notice: Subject to any disclaimer, the term of this patent is extended or adjusted under 35 U.S.C. 154(b) by 764 days.

(21) Appl. No.: 13/050,126

(22) Filed: Mar. 17, 2011

(65) Prior Publication Data

US 2011/0229376 A1 Sep. 22, 2011

Related U.S. Application Data

(60) Provisional application No. 61/340,384, filed on Mar. 17, 2010.

(51) Int. Cl.
*A62B 7/08* (2006.01)
*B03C 3/00* (2006.01)

(52) U.S. Cl.
USPC ..... 422/120; 96/78; 96/79

(58) Field of Classification Search
USPC ..... 422/120; 96/78, 79
See application file for complete search history.

(56) References Cited

U.S. PATENT DOCUMENTS 3,985,525 A * 10/1976 Tomaides ..... 96/79
4,478,613 A 10/1984 Brettschneider et al.
6,322,758 B1 11/2001 Hall et al.
6,475,350 B2 11/2002 Palekar et al.
6,537,507 B2 3/2003 Nelson et al.
6,797,241 B2 9/2004 Foster
6,821,493 B2 11/2004 Nelson et al.
6,902,604 B2 6/2005 Heckel et al.
6,938,409 B2 9/2005 Birckigt et al.
6,959,538 B2 11/2005 Cho et al.
7,067,092 B2 6/2006 Hall et al.
7,074,370 B2 7/2006 Segal et al.
7,163,663 B2 1/2007 Carlow et al.
7,364,606 B2 4/2008 Shimoda et al.
7,368,094 B2 5/2008 Cho et al.
7,398,643 B2 7/2008 Cotton
7,585,352 B2 9/2009 Dunn

FOREIGN PATENT DOCUMENTS

EP 0665061 A1 4/1999
JP 2004 204739 A 7/2004
WO 2007/067626 A2 6/2007

OTHER PUBLICATIONS

Jen-Shih Chang, "Next generation integrated electrostatic gas cleaning systems," Journal of Electrostatics, vol. 57, No. 4 (2003), pp. 273-291, Elsevier Netherlands.

(Continued)

*Primary Examiner* — Kevin Joyner
(74) *Attorney, Agent, or Firm* — Michael J. Brown

(57) ABSTRACT

The invention is an air pollution control apparatus for cleaning exhaust gases from motor vehicles using both electrostatic precipitation and a non-thermal plasma. The precipitator is especially useful in cleaning exhaust gases from diesel engines. The precipitator provides for easier cleaning in between uses, as well as a more efficient cleaning of exhaust gases. The air pollution control apparatus of the present invention is configured as two pass system whereas each pass is designed as multistage horizontal plate type electrostatic precipitator. The first pass applies a direct current, consistent voltage for particle collection through electrostatic precipitation. The second pass uses spiked voltage, non-thermal plasma generation for the production of free radicals to oxidize toxic gases, and with the addition of a diesel oxidation catalyst to transform harmful molecular compounds in the exhaust gas into safe gases.

20 Claims, 3 Drawing Sheets

(56) References Cited

OTHER PUBLICATIONS

Yoshihiro Kawada et al. "Development of High Collection Efficiency ESP by Barrier Discharge System," Conference Record of the 1999 IEEE Industry Applications Conference, 34th IAS Annual Meeting, vol. 2 (Oct. 3-Oct. 7, 1999), pp. 1130-1135, IEEE Piscataway, NJ, US.

H. Surati, M. Beltran and I. Raigorodsky, "Tubular Electrostatic Precipitators of Two-Stage Design", Environmental International, vol. 6, pp. 239-244, 1981.

S. Yao, "Plasma Reactors for Diesel Particulate Matter Removal", Recent Patents on Chemical Engineering, vol. 2, pp. 67-75, 2009.

* cited by examiner

ELECTROSTATIC FILTER AND NON-THERMAL PLASMA SYSTEM FOR AIR POLLUTION CONTROL OF HYDROCARBON COMBUSTION ENGINES

FIELD OF THE INVENTION

This invention is in the field of air pollution control and cleaning of exhaust gases from hydrocarbon combustion engines, specifically diesel engine exhaust gases.

BACKGROUND

The invention relates to the improvements in the field of air pollution control, specifically for removal of particulate matter (PM), nitrogen oxides ($NO_x$), hydrocarbons (HC), carbon monoxide (CO) and other toxic air pollutants from the exhaust of internal combustion engines and more specifically from diesel engines. Particulate matter, such as soot, emitted from diesel engines is very small—in most cases smaller than 1 micrometer, comparable in size with bacteria and 100 times smaller than human hair. These particles are complex, consisting of a carbon core, adsorbed hydrocarbons from diesel fuel and engine oil, adsorbed sulfates and inorganic materials from the engine wear. As early as 1988, the International Agency for Research on Cancer concluded that diesel particulate is probably carcinogenic to humans. Due to the small size of the particles, particulate matter is easily inhaled deep into lungs. $NO_x$ emissions from diesel engines also pose a number of health concerns, and may convert to nitric acid in lungs. CO is well known to be a deadly poison.

Diesel engine calibration can be adjusted within the temperature-atmosphere combustion map into regions of higher PM or $NO_x$ emissions. A combustion environment that contributes to higher PM emissions will naturally result in lower $NO_x$ and vice-versa.

In response to air quality regulations, vehicle manufacturers install pollution control devices in internal combustion engine exhaust systems. Existing engine pollution control devices often employ a ceramic honeycomb monolith having a coating of a noble metal catalyst. These pollution control devices catalyze the reactions of carbon monoxide and unburned hydrocarbons with oxygen at temperature ranging from 500 to 800 degrees Fahrenheit. Other devices employ catalysts that also catalyze the reaction of oxides of nitrogen.

Such catalysts are unsuitable for soot-laden gases that are produced by the diesel engines. Firstly, catalytic devices are ineffective at destroying soot. Secondly, the soot and other particulates remain as deposits on the ceramic monolith, preventing and restricting gaseous constituents from reaching the catalytic material or otherwise deactivating or poisoning the catalyst, greatly reducing the efficiency of the catalyst. The sulfur that is found in diesel and gasoline fuels can poison or deactivate the catalyst. Moreover, such devices induce a substantial back-pressure on the engine which reduces engine efficiency.

One of the methods used to reduce soot emissions from engine exhaust passes the engine exhaust gas through a ceramic filter, which filter can be periodically be replaced or regenerated. Such ceramic filters are only 85% efficient, impose significant back pressure on the engine and are expensive. For example, the loss of engine efficiency from filter back pressure can add between $3,000 and $6,000 in annual cost for a single school bus.

There are filters that regenerate themselves by burning some engine fuel, periodically oxidizing the accumulated soot. This extra fuel not only becomes expensive but also raises the total carbon footprint of the engine with the emission of more $CO_2$.

Particles of soot usually have some positive natural charge when they leave the combustion chamber of a diesel engine. The technology of removal of soot particles by conventional electrostatic precipitators with direct current high voltage power followed by vertical cyclonic separators is well known and documented (U.S. Pat. No. 4,478,613 and others), and also has been used extensively for many years in the carbon black production plants. However, such systems are often used in stationary installations such as factories.

Electrical force on a charged 0.1 micrometer particle can be more than 1 million times the gravitational force on that particle. Accordingly, electrostatic precipitators are particularly effective in removing particles less than 1 micrometer (1 micron) in size. Electrostatic precipitators offer high capture efficiency for sub-micrometer particulates by using electrical forces to remove suspended particles from a gas stream. For removing particles from a gas stream, a direct current (DC) high voltage is desired.

Typically, three steps are involved in an electrostatic precipitator: charging, collection and removal of the collected particles. A corona discharge electrically charges suspended particles, which are attracted to and collected on opposite charged electrodes. Removal of the particles from the electrodes can be done by shaking or washing the electrodes.

With dry electrostatic precipitators, collection chambers are prone to build-up of accumulated particles. This build-up acts as an insulation, which reduces overall system efficiency. Collecting plate electrodes of dry electrostatic precipitators are usually cleaned by shaking the dust off or if the accumulated material is oily or sticky, by washing them with hot water and detergent.

With wet electrostatic precipitators, a liquid, usually water, continually washes particle build-up from the collection surface during the precipitation process. For motor vehicles, carrying liquid for the wet electrostatic precipitator adds weight to the vehicle, reducing fuel economy.

An electrostatic precipitator is most efficiently cleaned when it is not in operation. Therefore, having an electrostatic precipitator which can go for long periods between cleaning is desired. Conventional electrostatic filters for smoke and oil mist removal usually have ceramic insulators that separate ionizing and collecting plates. The ceramic insulators are exposed to the same gas stream with its particulate load as the ionizing and collecting plates, and after time, the surface of the insulators become coated surface with particles or oil mist. For oil mist applications, this coating does not always impede the ability of the unit to operate, but since the soot particles from diesel engines are conductive, a coating of soot particles on the surface of the insulators will render the conventional unit inoperable.

In an electrostatic precipitator, corona power is the product of operating voltage and the operating corona current. Efficiency of an electrostatic precipitator is directly proportional to its corona power. Corona power is limited by internal sparking between ionizing and collecting electrodes. Each time a precipitator sparks, it reduces voltage and correspondingly, particulate collection efficiency. Corona current may also be suppressed when the incoming exhaust has an abnormally high load of soot, such as when the vehicle is accelerating. A large number of particles entering the precipitator may receive a charge, but not have had a chance to be collected on a collecting electrode. These charged particles prevent electron movement between the discharging and collecting electrodes and therefore manifest as less current available for charging and collection, also known as corona current suppression.

It is known in the art that an ionizing electrode functions most efficiently when the discharge points are as small as possible. Existing ionizing electrodes are often in the form of wires, but discharging electrodes have also been used in the form of a flat plate with points on a needle located along the outer periphery of the plate or rod shape of the ionizing electrodes. (See, H. Surati, M. Beltran and I. Raigorodsky (now known as Isaac Ray), "Tubular Electrostatic Precipitators of Two-Stage Design", Environmental International, Vol. 6, pp. 239-244, 1981). Ionizing wires, such as have been used in the industry, are usually very thin (twice as thick as human hair), presenting substantial operating problems due to frequent breaking, and preventing their use in moving vehicles.

SUMMARY OF THE INVENTION

The invention is an air pollution control apparatus for cleaning exhaust gases from motor vehicles using both electrostatic precipitation and a non-thermal plasma. The air pollution control apparatus is especially useful in cleaning exhaust gases from diesel engines. The air pollution control apparatus provides for easier cleaning in between uses, as well as a more efficient cleaning of exhaust gases.

Unlike conventional two stage electrostatic filters that have a short ionizing section comprised of thin corona wire and flat plates of opposite polarity, followed by large collecting section, the air pollution control apparatus of the present invention is configured as two pass system whereas each pass is designed as multistage horizontal plate type electrostatic precipitator. The first pass applies a direct current, low ripple high voltage for particle collection. The second pass uses pulsed high voltage plasma generation for the production of free radicals to remove molecular compounds in the exhaust gas. The free radicals generated by a high voltage field are very effective for removal of nitrogen oxides ($NO_x$), carbon monoxide (CO) and hydrocarbons (HC), while charged particles of soot are agglomerated and collected on the collecting plates. The soot particles can be removed periodically by a wash system attached to the unit during regular maintenance for the engine. After leaving the air pollution control apparatus, the exhaust gas can then undergo a final polishing in a diesel oxidation catalyst and be discharged out to the muffler and tail pipe. The diesel oxidation catalyst is preferably constructed with a metallic substrate and connected to the same ground as the precipitator.

The invention incorporates the use of a clean and hot air purge system that utilizes the heat from the combustion engine to preheat ambient air, which is passed by the insulators to help keep the insulators dry and free from particle buildup. This preheated ambient air has a higher oxygen and water vapor content than exhaust gases, and being introduced into the precipitation chamber assists in the generation of plasma within the electrostatic precipitator, by providing higher oxygenated air for the production of free radicals during pulsed high voltage generation.

Since the conventional direct current corona discharge does not provide the required amount of oxidizing free radicals for $NO_x$ removal, the invented plate type horizontal electrostatic precipitator is constructed with multiple discharge points on each plate with several plates in the direction of the gas flow (multistage) in a two pass configuration.

The main attributes of the invention are as follows. Electrostatic charging, agglomeration and cold plasma flameless oxidation take place simultaneously in the horizontal electrostatic precipitator. Agglomerated particles of soot are separated from the moving gas and collected on the plates. Having the assembly in one horizontal unit without any elbows or turns in the exhaust gas travel path is of particular advantage for mounting on motor vehicles.

The invention provides a higher efficiency with smaller surface area and size of the equipment regardless of the amount of inlet particulate load during the engine acceleration. The invention provides high efficiency in exhaust gas cleaning regardless of the nature and polarity of the particles in the inlet gas stream. The wave shape of high voltage output on each pass can be different to match the nature of the incoming particles. Solid metallic ionizing plates with serrated sharp edges provide higher corona current than typical ionizing wires. Also, the use of multiple ionizing plates within each pass can provide as much current as required not only for the particulate removal but also for the non-thermal plasma free radicals generation. One of the passes, preferably the second, can be configured strictly as non-thermal plasma generator by powering it with high frequency pulsing wave shape voltage with high rise and short duration. The clean and hot air purge subsystem prevents the buildup of particles on insulators that occurs in conventional electrostatic precipitator filters. The separate passes of the invention can be implemented individually as desired for exhaust gas treatment for either particle collection or free radical generation.

DETAILED DESCRIPTION OF THE PREFERRED EMBODIMENT

Figure 1:
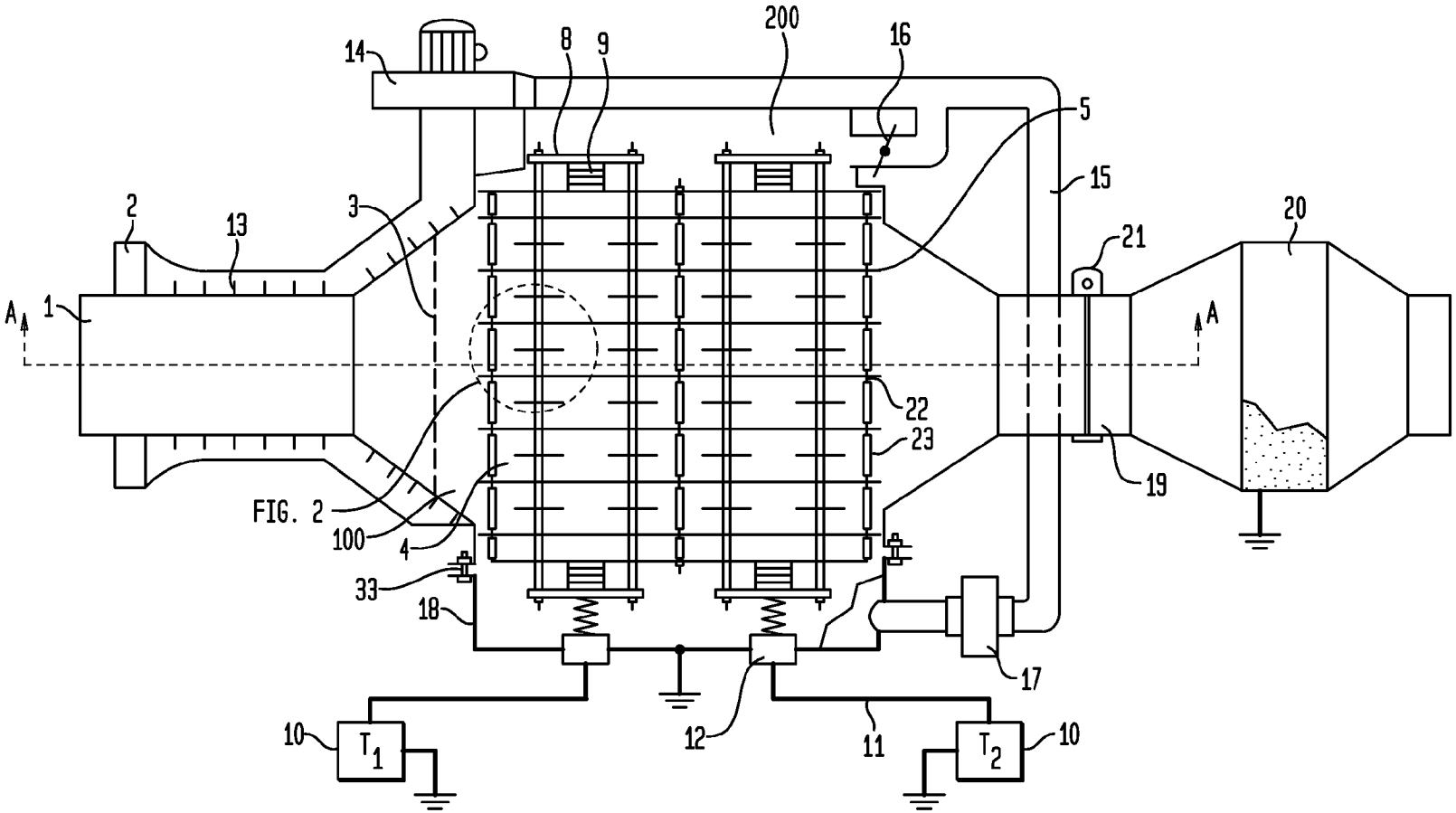
FIG. 1 is a top plan view of a preferred embodiment of the invention

The invention preferably consists of a precipitation chamber 100 with an inlet 1 and an outlet port 19. Exhaust enters inlet 1 and is diffused through diffusion plate 3 before entering the precipitation chamber 100.

Precipitation chamber 100 contains a plurality of planar collecting plate electrodes 5 arranged in an array. Collecting plates 5 are assembled on support rods 22 and preferably are separated from each other by conducting support spacers 23. Alternatively, collecting plates 5 may be welded together to form a solid frame within the precipitation chamber, however due to the high temperatures present within the precipitation chamber, such a frame may be subject to warping or distortion. Accordingly, the preferred embodiment implements support spacers 23 to maintain consistent orientation of collecting plate electrodes. Each of the planar collecting plate electrodes 5 has at least one opening 30 through the plane of the collecting plate electrode 5. Openings 30 are preferably round, to avoid creating a focal point for a coronal discharge.

Connecting rod 7 passes through opening 30 in each collecting electrode 5. Ionizing electrode plates 4 are assembled on the connecting rods 7, separated from each other and from the collecting plate electrodes 5. In the preferred embodiment, conducting spacers 6 are placed between ionizing plates 4 and along connecting rod 7 to provide precise and long lasting alignment of the entire assembly.

The distance K between ionizing plates 4 and collecting electrodes 5 is the function of the operating voltage at a ratio of 15,000 volts per one inch of the distance. For example, where the space between electrodes K=0.5 inches, the required transformer voltage should be approximately 7,500 volts. However, the transformer voltage can be adjusted to higher values to match the quality of the assembly or the conditions of the exhaust gas.

To prevent arcing between negative ionizing plates 4 and positive (grounded) collecting plates 5, the distance L between the surface of the conducting spacer 6 and the edge of the round opening 30 on collecting plate electrode 5 should be 1.5 times the value of K, or L=1.5 K.

Figure 3:
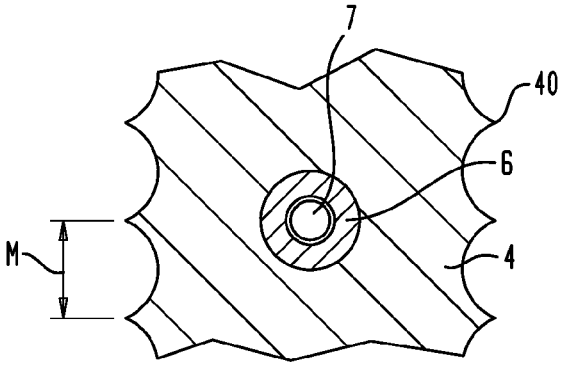
FIG. 3 is a cross sectional view along line B-B in FIG. 2.
Figure 4:
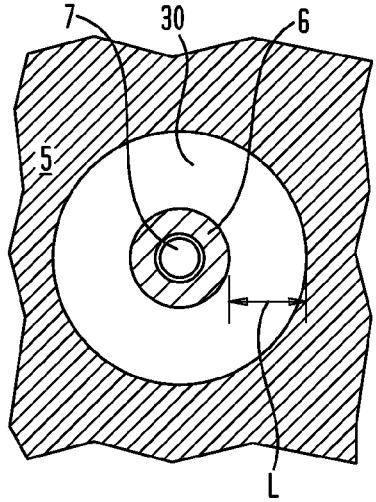
FIG. 4 is a cross sectional view along line C-C in FIG. 2.

The ionizing plates 4 are constructed as solid metal flat plates with serrated edges along their periphery, with multiple sharp ionizing points 40. These sharp ionizing points 40 provide a higher corona current and hence higher efficiency, allowing for a smaller overall equipment size, while still handling the incoming particulate load and gas volume. As shown in FIG. 3, the distance between adjacent sharp ionizing points 40 is distance M, which is preferably 0.75 times K to optimize the corona current. Experiments have shown that distances less than or greater than 0.75 times K show a reduction in corona current generation and efficiency of particulate removal.

The sharp ionizing points 40 can provide a much higher corona current than typical ionizing wires. The higher current, combined with the use of multiple ionizing plates 4 can provide not only the necessary current for particulate removal, but also for non-thermal plasma generation of free radicals. Where multiple pass units are provided, one such pass unit can be configured as a strictly non-thermal plasma generator by powering it with high frequency pulsing wave shape voltage with high rise and short duration.

The ionizing plates 4 also act as repelling surfaces for particulate matter during the collection process, thus insuring much higher collection efficiency for particles of soot that usually have a some natural positive charge when they leave the combustion engine.

End plates 8 are attached at each end of rod 7. End plates 8 are attached to the grounded frame or the outermost collecting electrode 5 by insulators 9. Insulators 9 prevent an electrical connection between the grounded frame and rod 7. Insulators 9 are preferably ceramic, but may be made of any insulating material.

High voltage transformers 10 (also T1 and T2) are electrically connected to the end plates 8 by the cables 11 and also to insulator-spring assembly 12 that is attached to the housing cover 18. In the preferred embodiment, transformer T1 is electrically connected to rod 7 through end plate 8 to create a constant voltage differential VV1 between ionizing plates 4 and collecting electrodes 5.

As shown in FIG. 1, in the preferred two pass configuration, a second set of rod 7 and ionizing plates 4 are electrically connected to a second transformer T2 to create a voltage differential VV2 between the ionizing plates 4 of the second set and collecting electrodes 5. Transformer T2 preferably generates voltage VV2 in spikes, rather than a constant level. Voltage VV1 and VV2 may be the same voltage or different voltages, and may be produced with identical waveforms or different wave forms. In the preferred embodiment, transformer T2 generates high voltage with short duration and fast rise for plasma generation for the removal of $NO_x$, CO and HC molecules.

For the most efficient production of oxidizing free radicals, one of the power supplies, preferably the second pass transformer T2, produces high frequency pulses of short duration and high rise. The same high voltage field has strong influence on particles of soot that are undergoing extensive agglomeration and collection.

Figure 2:
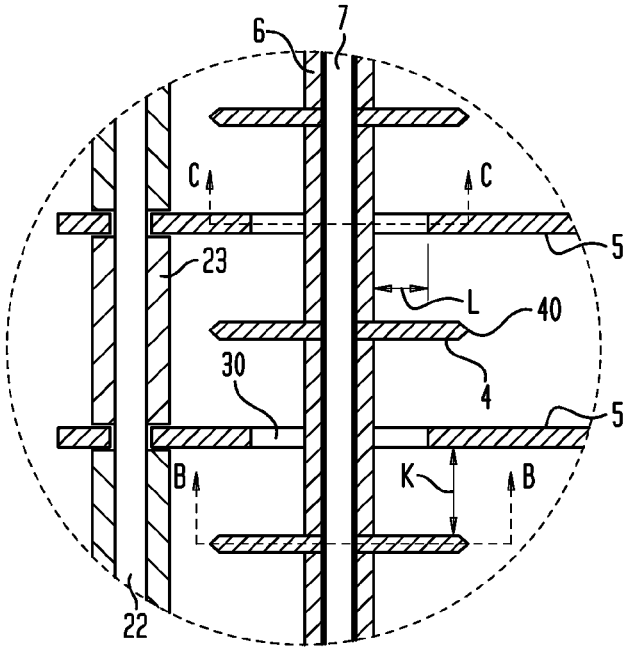
FIG. 2 is a cross sectional view of a section of the precipitation chamber of the invention, showing the ionizing plates and collecting plate electrodes.

The plasma generated through the voltage spikes produces chemically active species and free radicals such as: O, $O_3$, $HO_2$, and OH. The production of those radicals takes place when highly energetic electrons from the high voltage pulse discharge in the Pass #2 (FIG. 2) bombard the molecules of water vapor and oxygen from the exhaust gas or when molecules of oxygen combine and generate $O_3$ and O radicals. The free radicals interact with the $NO_x$, CO and HC molecules through gas phase reactions to neutralize the toxic compounds and produce safer molecules to be expelled from the precipitation chamber.

The $NO_x$ removal from the diesel exhaust is provided by the oxidation of NO portion of NO by the O-radicals, $O_3$, $HO_2$ into $NO_2$ and further reduction of $NO_2$ into $N_2$ on diesel oxidation catalyst 20. The CO and unburned hydrocarbon compounds (HC) are also oxidized by the same radicals in to harmless $CO_2$ and $H_2O$ (water).

Total collecting efficiency of the two pass precipitator can be calculated as:

$$Eff\,t=1-[(1-Eff\,1p)\times(1-Eff\,2p)]$$

where Eff 1p and Eff 2p are efficiency of the first and second pass in decimal fractions. It can be seen that if the efficiency of each pass is 90% or 0.9 then the total efficiency for the invention will be 0.99 or 99%, making the unit 10 times more efficient.

A two field or two pass arrangement of ionizing plate 4 and collector electrodes 5 eliminates the negative effect of corona current suppression. After the exhaust gas undergoes cleaning in the first pass under suppression conditions, the exhaust gas entering the second pass has fewer particles, allowing the second pass to operate at very high efficiency for generation of free radicals that will remove $NO_x$, CO and hydrocarbons.

To prevent contamination the surface of insulators 9 by the particles of soot, and to assist in the generation of free radicals, the invention uses an air purge subsystem to create a positive pressure in the insulator compartment 200, preventing the contaminated exhaust gas from entering, and introducing heated ambient air into the precipitation chamber.

The air purge subsystem is comprised of inlet filter 2, heat exchanger 13, high pressure blower 14, hot air duct 15, damper 16, and connecting union 17.

Ambient air, preferably from a source located distant from any exhaust outflow, enters inlet filter 2. Inlet filter may be a disposable or washable high temperature dust filter or any other filter designed to prevent dust particles from entering the air purge subsystem. After passing through inlet filter 2, the ambient air is heated by heat exchanger 13. The source of heat for heat exchanger 13 is preferably from the engine exhaust entering the precipitation chamber, thereby providing an efficient use of what would otherwise be waste heat.

The heated ambient air is drawn into high pressure blower 14 and expelled into hot air duct 15 at a higher pressure than the exhaust gas stream. Hot air duct 15 allows for the distribution of the heated ambient air to desired locations near ceramic insulators 9, and may include branches or sub ducts as necessary for efficient air flow. Damper 16 allows for the controlled entry of the heated ambient air from air duct 15 into insulator compartment 200.

As there necessarily must be a gap (preferably of at least 1.5 K) between the precipitation chamber 100 and rod 7, to avoid either a direct electrical connection or arcing between rod 7 and collecting electrodes 5, the higher pressure differential between the heated ambient air and the exhaust gas stream results in a one-way air flow from the insulator compartment 200 into the precipitation chamber 100, keeping the exhaust gas from entering the insulator compartment 200.

In operation, diesel exhaust gas is directed from a diesel engine into inlet port 1 of precipitation chamber 100. The diesel exhaust hits diffusion plate 3, which allows for more uniform gas flow distribution into the precipitation chamber 100. Low ripple direct current high voltage VV1 applied to ionizing plates 4 creates a corona discharge of electrons at sharp ionizing points 40. The electrons bind with the particles in the diesel exhaust, charging them with a negative charge and causing them to become attracted to positive collecting electrodes 5. Pulsed high voltage VV2 generates plasma to create free radicals from the gases within the precipitation chamber 100, which free radicals interact with the $NO_x$, CO and HC molecules through gas phase reactions to neutralize the toxic compounds.

Substantially clean and odor free exhaust gas leaves the system via the outlet 19 to a diesel oxidation catalyst filter 20 and then to the muffler and tail pipe. The diesel oxidation catalyst filter 20 is preferably constructed with a metallic substrate, electrically connected to ground, thereby providing additional particulate matter removal. Any particulate matter that still possesses a residual charge and which may have escaped the precipitation chamber 100, will become attracted to the grounded metallic substrate of the diesel oxidation catalyst filter 20. The exhaust gas at this point practically free from soot particles and a substantial portion of the nitrogen oxides have been converted to $NO_2$. The flow-through oxidation catalyst can be manufactured with less stringent requirements, since the gas to be processed is already partially clean, resulting in a substantial reduction of cost and less usage of costly platinum and/or palladium.

For cleaning the precipitation chamber 100 during maintenance, spray nozzles 50 are provided in the periphery of precipitation chamber 100. Precipitation chamber 100 also has a drain 53, preferably located on the lower side of precipitation chamber 100 to allow for gravity drainage. The spray nozzles 50 are aligned to spray in between collecting electrodes 5. Spray nozzles 50 are connected to conduit 500, which terminates at valve 51. Valve 51 is preferably located on an accessible point on the exterior of the invention. Hose connector 52 is provided near valve 51 for attaching an external hose. The external hose may be connected to a water supply or a detergent and water supply as desired. In the preferred embodiment, water heated to a temperature of 160 to 180 degrees Fahrenheit is used.

Figure 5:
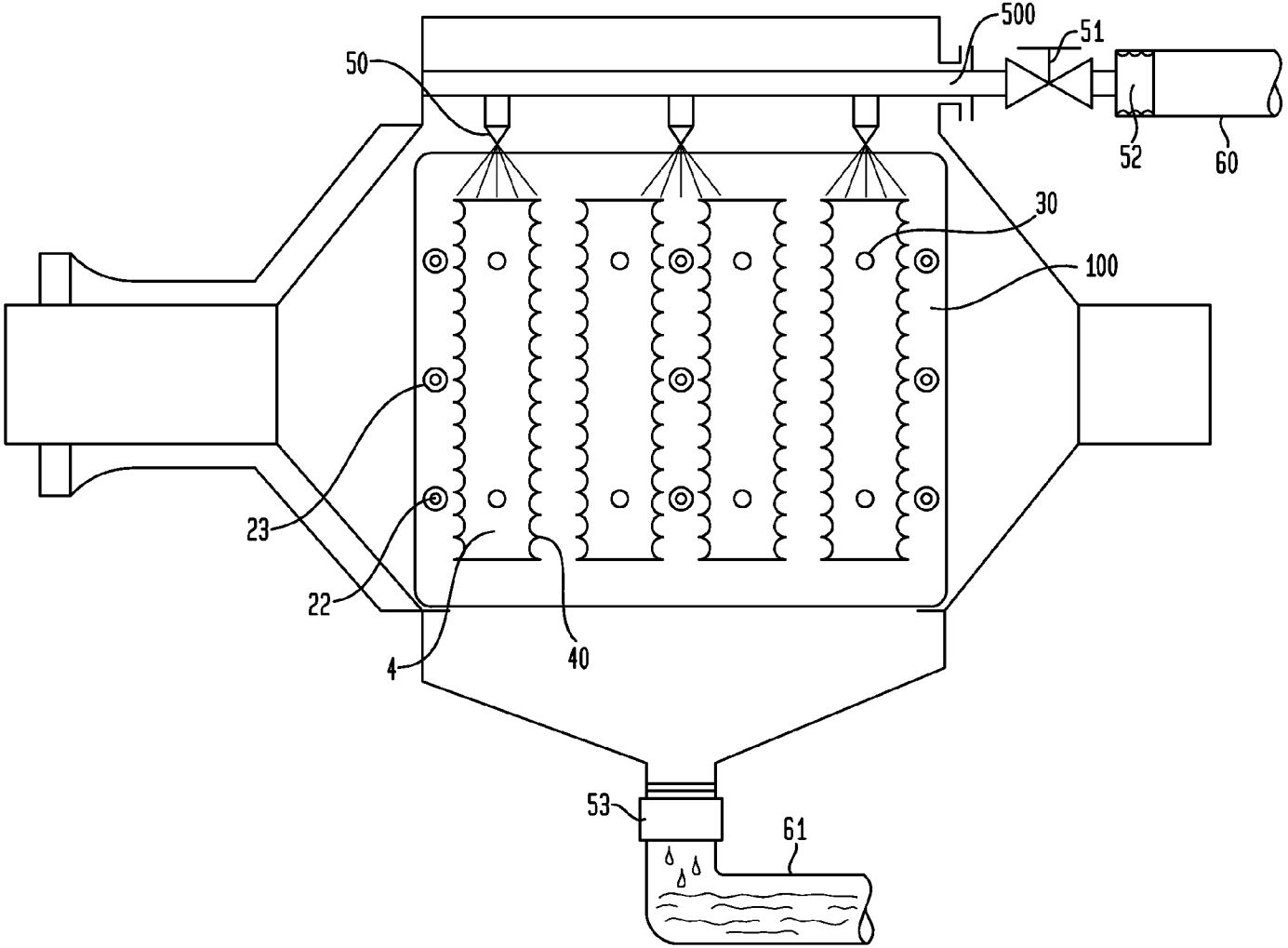
FIG. 5 is a cross sectional view along line A-A in FIG. 1.

As shown in FIG. 5, when the precipitation chamber is to be cleaned, an external water supply hose 60 is attached to hose connector 52, valve 51 is opened and the water and/or detergent enters precipitation chamber 100 through spray nozzles 50. The water and/or detergent is directed onto the surfaces of collecting electrodes 5, to wash off the particulate matter and other residue from the collecting electrodes. The water and/or detergent with dislodged particulate matter and other residue exits precipitation chamber 100 at drain 53. An external drainage hose 61 may be attached to drain 53 to allow for the capture and treatment of the drained slurry and water.

Alternatively, housing cover 18 may be opened by releasing cover bolts 33 to provide access to precipitation chamber 100. Connecting union 17 may also be disconnected as well as exhaust connector 21 to allow for removal or service to the unit.

While certain novel features of the present invention have been shown and described, it will be understood that various omissions, substitutions and changes in the forms and details of the device illustrated and in its operation can be made by those skilled in the art without departing from the spirit of the invention

I claim:

1. An air pollution control apparatus for hydrocarbon combustion engines comprising:

a precipitation chamber with an electrical ground connection;

an inlet port connected to the precipitation chamber;

an outlet port connected to the precipitation chamber;

a first and a second plate assembly, each plate assembly comprised of at least two planar collecting plate electrodes within and electrically connected to the precipitation chamber, where the collecting plate electrodes have at least one opening within the plane of the collecting plate electrode;

a rod passing through the openings of the collecting plate electrodes;

an ionizing plate mounted on the rod, where the ionizing plate has sharp discharge points along a periphery of the ionizing plate, and where the ionizing plate is mounted at a predetermined distance K away from a nearest collecting plate electrode;

a first end plate attached to a first end of the rod, a second end plate attached to a second end of the rod; and an insulator securely mounting each end plate to the precipitation chamber;

a first transformer electrically connected to the first or second end plate of the first plate assembly, the first transformer capable of inducing a first voltage differential between the ionizing plate attached to said rod and the collecting plate electrodes; and a second transformer electrically connected to the first or second end plate of the second plate assembly, the second transformer capable of inducing a second voltage differential between the ionizing plate attached to said rod and the collecting plate electrodes.

2. The air pollution control apparatus of claim 1, where the first transformer generates a low ripple direct current high voltage and the second transformer generates a high voltage with fast, short duration electrical pulses.

3. The air pollution control apparatus of claim 1, where the distance K is a function of the first voltage differential at a ratio of 15,000 volts per one inch of distance K.

4. The air pollution control apparatus of claim 1, where the openings in the collecting electrodes have an interior edge and the distance between the interior edge of the openings and the rod is a distance between one and two times K.

5. The air pollution control apparatus of claim 4, where the distance is 1.5 times K.

6. The air pollution control apparatus of claim 1, where the sharp points on the ionizing plates are separated by a distance of 0.75 times K.

7. The air pollution control apparatus of claim 1, where the number of ionizing plates is one less than the number of collecting electrode plates.

8. The air pollution control apparatus of claim 1, further comprising:

at least two conducting spacers located around each rod, placed adjacent to the ionizing plate, where the conducting spacers pass through the openings in the collecting plate electrodes and maintain the ionizing plate a constant distance from the collecting plate electrodes.

9. The air pollution control apparatus of claim 8, where the openings in the collecting electrodes have an interior edge and the distance between the interior edge of the openings and the conducting spacers is a distance between one and two times K.

10. The air pollution control apparatus of claim 1, further comprising:

a plurality of conducting electrode spacers between each of the collecting plate electrodes, placed between adjacent collecting plate electrodes, where the conducting electrode spacers maintain a constant distance between adjacent collecting plate electrodes.

11. The air pollution control apparatus of claim 1, further comprising:

an insulator chamber surrounding the insulators;

a conduit connected to the insulator chamber;

a high pressure blower with an input port and an output port connected to the conduit;

an inlet filter connected to the input port of the high pressure blower; and a heat exchanger between the inlet filter and the input port of the high pressure blower, capable of transferring thermal energy from the inlet port of the precipitation chamber.

12. The air pollution control apparatus of claim 1, further comprising:

a diesel oxidation catalyst connected to the outlet port, where the diesel oxidation catalyst comprises a metallic substrate that is electrically connected to ground.

13. The air pollution control apparatus of claim 1, further comprising:

a plurality of spray nozzles mounted in walls of the precipitation chamber, the spray nozzles directed at the collecting plate electrodes;

elongated piping connected at one end to the spray nozzles;

a valve with input and output openings, connected at the output opening to the other end of the elongated piping; and hose connecting means connected to the input opening of the valve.

14. An air pollution control apparatus comprising:

a precipitation chamber with an electrical ground connection;

an inlet port connected to the precipitation chamber;

an outlet port connected to the precipitation chamber;

at least two planar collecting plate electrodes within and electrically connected to the precipitation chamber, where the collecting plate electrodes have at least one opening within the plane of the collecting plate electrode;

a rod passing through the openings of the collecting plate electrodes;

an ionizing plate mounted on the rod, where the ionizing plate has sharp discharge points along a periphery of the ionizing plate, and where the ionizing plate is mounted at a predetermined distance K away from a nearest collecting plate electrode;

a first end plate attached to a first end of the rod, a second end plate attached to a second end of the rod;

an insulator securely mounting each end plate to the precipitation chamber; and a transformer electrically connected to the rod, the transformer capable of inducing a voltage differential between the ionizing plate and the collecting plate electrodes.

15. The air pollution control apparatus of claim 14, where the transformer generates a direct current high voltage of a low ripple waveform.

16. The air pollution control apparatus of claim 14, where the transformer generates a high voltage with pulses of short duration and fast rise.

17. The air pollution control apparatus of claim 14, further comprising a second transformer.

18. An air pollution control apparatus comprising:

a precipitation chamber with an electrical ground connection;

an inlet port connected to the precipitation chamber;

an outlet port connected to the precipitation chamber;

a first and a second plate assembly, each plate assembly comprised of at least two planar collecting plate electrodes within and electrically connected to the precipitation chamber, where the collecting plate electrodes have at least one opening within the plane of the collecting plate electrode;

a rod passing through the openings of the collecting plate electrodes;

an ionizing plate mounted on the rod, where the ionizing plate has sharp discharge points along a periphery of the ionizing plate, and where the ionizing plate is mounted at a predetermined distance K away from a nearest collecting plate electrode;

a first end plate attached to a first end of the rod, a second end plate attached to a second end of the rod; and, an insulator securely mounting each end plate to the precipitation chamber;

a first transformer electrically connected to the first or second end plate of the first plate assembly, the first transformer capable of inducing a first voltage differential between the ionizing plate attached to said rod and the collecting plate electrodes;

a second transformer electrically connected to the first or second end plate of the second plate assembly, the second transformer capable of inducing a second voltage differential between the ionizing plate attached to said rod and the collecting plate electrodes;

an insulator chamber surrounding the insulators;

a conduit connected to the insulator chamber;

a high pressure blower with an input port and an output port connected to the conduit;

an inlet filter connected to the input port of the high pressure blower; and a heat exchanger between the inlet filter and the input port of the high pressure blower, capable of transferring thermal energy from the inlet port of the precipitation chamber.

19. The air pollution control apparatus of claim 18, where the first transformer generates a direct current high voltage of a low ripple waveform and the second transformer generates a high voltage with pulses of short duration and fast rise.

20. The air pollution control apparatus of claim 18, where the openings in the collecting electrodes have an interior edge and the distance between the interior edge of the openings and the rod is a distance between one and two times K.

* * * * *